US007673986B2

(12) United States Patent
Nakashima

(10) Patent No.: US 7,673,986 B2
(45) Date of Patent: Mar. 9, 2010

(54) INKJET RECORDING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 687 days.

(21) Appl. No.: 11/557,810

(22) Filed: Nov. 8, 2006

(65) Prior Publication Data

US 2007/0146416 A1 Jun. 28, 2007

(30) Foreign Application Priority Data

Nov. 8, 2005 (JP) ..... 2005-323882

(51) Int. Cl.
*B41J 2/01* (2006.01)
*B41J 2/165* (2006.01)

(52) U.S. Cl. ..... 347/104; 347/33; 347/28; 347/23

(58) Field of Classification Search ..... 347/104, 347/33, 28, 21, 23
See application file for complete search history.

(56) References Cited

U.S. PATENT DOCUMENTS 4,968,997 A * 11/1990 Saitoh et al. ..... 346/136

FOREIGN PATENT DOCUMENTS

JP 2002296921 A 10/2002
JP 2003170578 A 6/2003
JP 2004137032 A 5/2004
JP 2004196505 A 7/2004

* cited by examiner

*Primary Examiner*—Shih-Wen Hsieh
(74) *Attorney, Agent, or Firm*—Baker Botts L.L.P.

(57) ABSTRACT

An inkjet recording apparatus includes a belt transporting apparatus, a nip roller nipping a recording medium in cooperation with an outer peripheral face of a transport belt at a predetermined position, a nip-roller moving mechanism, an inkjet head, an applying unit which applies cleaning fluid to the outer peripheral face, a blade which is in contact with the outer peripheral face on a downstream side of a position where the cleaning fluid is applied to the outer peripheral face to scrape off the cleaning fluid and ink that adhere to the outer peripheral face, a travel controlling unit which controls the transport belt driving unit to cause the transport belt to travel, and a nip-roller movement controlling unit which causes the nip roller to be contacted with the outer peripheral face after an initial contact place passes the predetermined position.

9 Claims, 10 Drawing Sheets

INKJET RECORDING APPARATUS

CROSS REFERENCE TO RELATED APPLICATION

This application claims priority from Japanese Patent Application No. 2005-323882, filed on Nov. 8, 2005, the entire subject matter of which is incorporated herein by reference.

TECHNICAL FIELD

Aspects of the present invention relate to an inkjet recording apparatus in which ink droplets are ejected to a recording medium to perform printing.

BACKGROUND

There is an inkjet recording apparatus in which ink droplets are ejected from an inkjet head to print a desired image on a print sheet that is a recording medium. The print sheet is placed on a transport belt and transported while being pressed against the transport belt by a nip roller. In the inkjet recording apparatus, inks splashing in the printing process sometimes adhere to the transport belt. When inks adhere to the transport belt, the print sheet is easily smeared. Therefore, a technique is known in which an absorbing member absorbing cleaning fluid is in contact with a driven transport belt, thereby causing the cleaning fluid to adhere to the transport belt, and the cleaning fluid adhering to the transport belt is wiped out together with the cleaning fluid by a rubber blade or the like, whereby inks adhering to the transport belt are removed away together with the cleaning fluid (for example, see JP-A-2004-196505).

SUMMARY

In the above-described technique, when the transport belt travels, the cleaning fluid and inks, which are wiped by the rubber blade, accumulate in a gap between the rubber blade and the transport belt. When the travel of the transport belt in this state is stopped, or when the transport belt at rest restarts to travel, the transport belt vibrates, and the cleaning fluid and inks which accumulate in the gap between the rubber blade and the transport belt sometimes leak through the gap toward the downstream side in the travel direction of the transport belt. Namely, the cleaning fluid and the ink adhere to the downstream side from a portion of the transport belt, which is in contact with the rubber blade, in the travel direction of the transport belt. In the case where the cleaning fluid and the inks adhere to the transport belt, when the transport belt restarts to travel, the cleaning fluid and inks, which adhere to the transport belt, adhere to the printing sheet via the nip roller.

Aspects of the invention provide an inkjet recording apparatus, in which cleaning fluid can be prevented from adhering to a print sheet.

DETAILED DESCRIPTION

Hereafter, illustrative aspects of the invention will be described with reference to the accompanying drawings.

First Aspect

Figure 1:
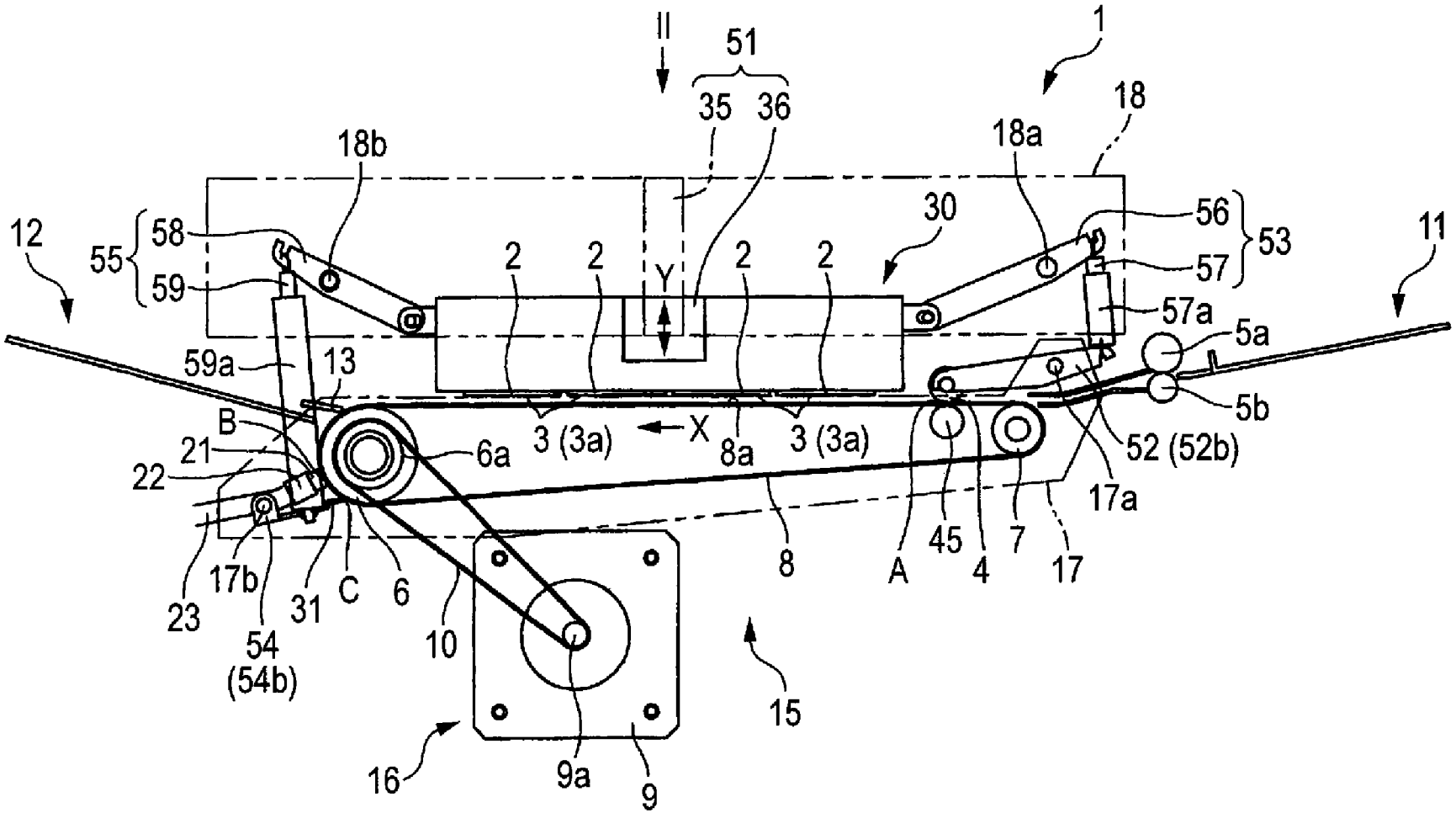
FIG. 1 is a side view showing the configuration of an inkjet printer according to a first aspect of the invention.
Figure 2:
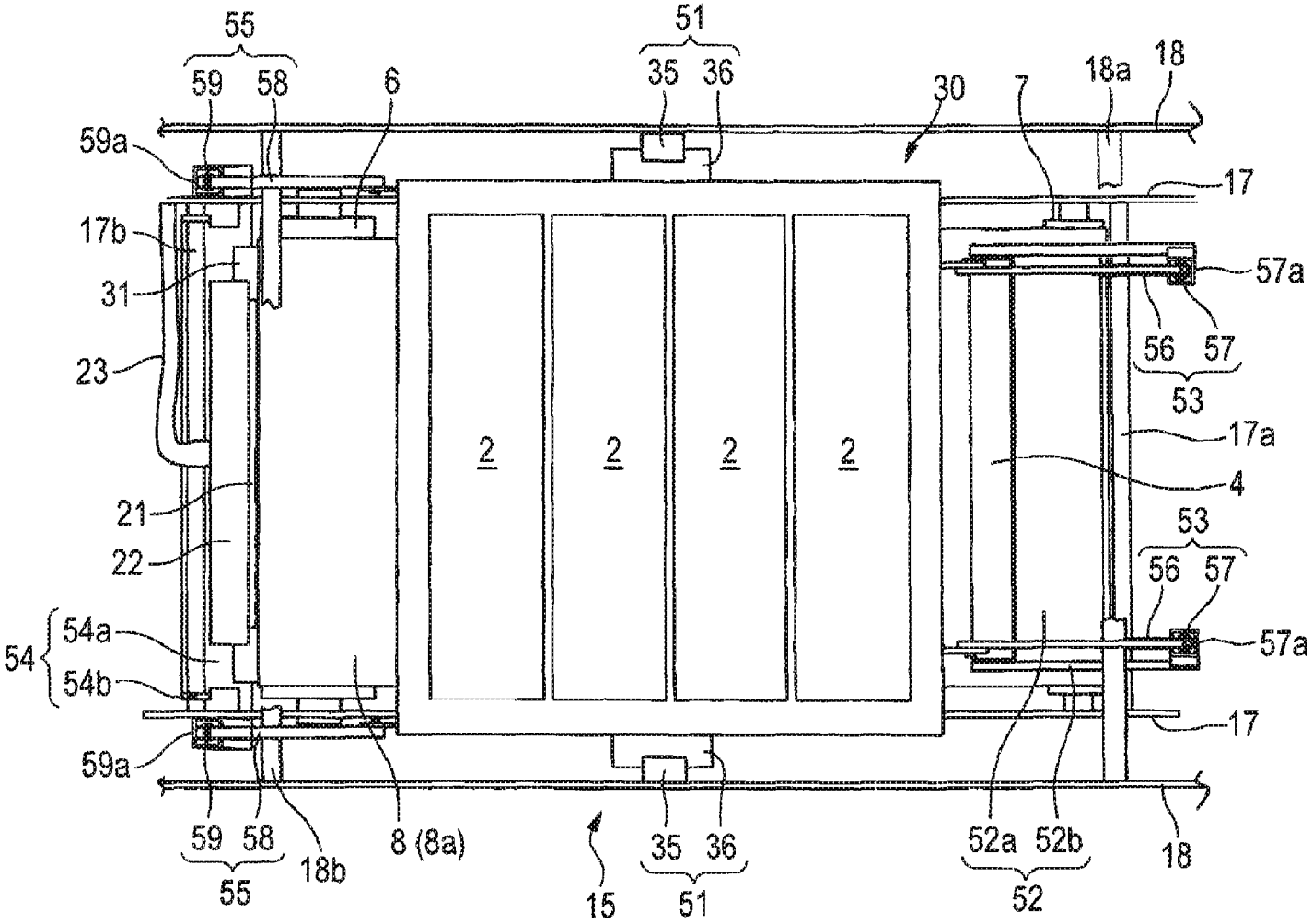
FIG. 2 is a top view showing the configuration of the inkjet printer shown in FIG. 1.

FIG. 1 is a schematic side view showing the configuration of an inkjet printer according to a first aspect of the invention, and FIG. 2 is a schematic top view of the inkjet printer 1 as viewed in the direction of the arrow II shown in FIG. 1. As shown in FIGS. 1 and 2, the inkjet printer (inkjet recording apparatus) 1 is a color inkjet printer having four inkjet heads. In the inkjet printer 1, a sheet supplying portion 11 is configured in the right side of FIG. 1, and a sheet discharging portion 12 is configured in the left side of FIG. 1. The inkjet printer 1 has a controlling section 60 (see FIG. 6) for controlling the inkjet printer 1.

In the inkjet printer 1, a sheet transporting path through which a print sheet (recording medium) is transported from the sheet supplying portion 11 toward the sheet discharging portion 12 is formed. A pair of feed rollers 5*a*, 5*b* which nip and transport the print sheet are placed downstream from the sheet supplying portion 11. The feed rollers 5*a*, 5*b* are rotated by a feed motor 14 (see FIG. 8). The print sheet is fed by the pair of feed rollers 5*a*, 5*b* from the right side of FIG. 1 to the left side. A belt transporting apparatus 15 is disposed in the intermediate portion of the sheet transporting path. The belt transporting apparatus 15 has belt rollers 6, 7, a transport belt 8, and a transport belt driving device 16. The belt rollers 6, 7 are rotatably supported by a lower frame 17. The transport belt 8 is an endless belt, which is looped around the rollers 6, 7. A silicone treatment is applied to the outer peripheral face 8*a* of the transport belt 8 so that the face has an adhesion.

The transport belt driving device 16 is used for causing the transport belt 8 to travel. The transport belt driving device 16 has a transport motor 9 and a drive belt 10. The transport motor 9 is placed under the transport belt 8. The drive belt 10 is looped around a rotation shaft 9*a* of the transport motor 9 and a shaft 6*a* of the belt roller 6. When the rotation shaft 9*a* of the transport motor 9 rotates in a counterclockwise direction in FIG. 1, the belt roller 6 is rotatingly driven in a counterclockwise direction in FIG. 1. Then, the transport belt 8, which is looped around the belt rollers 6, 7, travels in the sheet transportation direction (indicated by the arrow X in FIG. 1) in accordance with the rotation of the belt roller 6. In this way, the transport belt 8 can transport the print sheet toward the downstream (left side) by means of the rotational driving of the belt roller 6 in a counterclockwise direction in FIG. 1, while holding the print sheet by its adhesion. A stripping mechanism 13 is disposed immediately downstream of the transport belt 8 along the sheet transporting path. The stripping mechanism 13 strips the print sheet adhered to the outer peripheral face 8*a* of the transport belt 8, from the outer peripheral face 8*a*, and sends the stripped print sheet toward the sheet discharging portion 12.

A lower roller 45 is disposed immediately downstream of the belt roller 7. The lower roller is rotatably supported by the lower frame 17 and is in contact with the whole area in the width direction of the inner peripheral face of the transport belt 8. Ahead unit 30, a head unit moving mechanism (head moving mechanism) 51, a nip-roller support plate (nip-roller moving 4 mechanism) 52, a nip-roller interlocking mechanism (first interlocking mechanism) 53 are disposed above the transport belt 8. Further, a blade support plate (blade moving mechanism) 54 and a blade interlocking mechanism (second interlocking mechanism) 55 are disposed.

The head unit 30 supports four inkjet heads 2. The four inkjet heads 2 correspond inks of four colors (magenta, yellow, cyan, black), respectively and are arranged in the sheet transportation direction. Namely, the inkjet printer 1 is a line-type printer. Each of the four inkjet heads 2 has a head body 3 in the lower end. The head body 3 is configured such that a flow path unit, in which ink flow paths each having a nozzle and a pressure chamber are formed, and an actuator for applying a pressure to the pressure chambers are boded together. The head body 3 is formed into a parallelepiped shape, which is elongated in a direction perpendicular to the sheet transportation direction. Many small-diameter nozzles for downward ejecting inks are juxtaposedly arranged in the lower face of the head body 3. The lower face functions as an ink ejection face 3*a*, which is opposed to the outer peripheral face 8*a*.

The head body 3 is placed so that the ink ejection face 3*a* is parallel to the outer peripheral face 8*a* of the transport belt 8. As described later, when the head unit 30 is in "recording-enabled state" (the state shown in FIG. 1), a small gap is formed between the ink ejection face 3*a* and the outer peripheral face 8*a* of the transport belt 8. The sheet transporting path is formed in the gap. In this state, when the print sheet transported on the transport belt 8 sequentially passes below the four head bodies 3, the inks of the colors are ejected toward the upper face, i.e., a print face of the print sheet, whereby a desired color image can be formed on the print sheet.

The head unit moving mechanism 51 raises and lowers the head unit 30 (see the arrow Y in FIG. 1). The head unit moving 4 mechanism 51 has: guide rails 35 which extend in the vertical direction on faces of an upper frame 18, the faces being opposed to the head unit 30; and linear motors 36 disposed on side faces of the head unit 30 which are opposed to the upper frame 18. The linear motor 36 can travel along the guide rail 35. According to the configuration, the head unit moving mechanism 51 can relatively move the head unit 30 in the vertical direction with respect to the transport belt 8, so as to take "recording-enabled state" where the inkjet heads 2 are close to the transport belt 8, or "retracted state" where the inkjet heads are more separate from the transport belt 8 as compared with the case of the recording-enabled state. FIG. 1 corresponds to the case where the head unit 30 is in "recording-enabled state".

The nip-roller support plate 52 is a planar member configured by a rectangular main portion 52*a*, and two side walls 52*b* which are connected respectively to the both ends; of the main portion 52*a* in the belt width direction so as to be placed perpendicular to the main portion 52*a*. The side walls 52*b* are formed so as to project in the longitudinal direction of the transport belt 8 from the main portion 52*a* toward the right side of FIG. 2. Two circular through holes are formed at the same positions of the side walls 52*b*. A shaft 17*a* through which the pair of lower frames 17 are coupled with each other is inserted into one of the through holes of each of the side walls 52*b*. Therefore, the nip-roller support plate 52 is swingable with respect to the shaft 17*a*. A rotation center shaft (not shown) of a nip roller 4 having a length which is substantially equal to the width of the transport belt 8 is inserted into the other through holes of the side walls 52*b*. Therefore, the nip roller 4 is supported so as to be rotatable with respect to the nip-roller support plate 52.

In the state shown in FIG. 1, the nip roller 4 is contacted at a nip position A with the outer peripheral face 8*a* of the transport belt 8. At this time, the print sheet fed by the feed rollers 5*a*, 5*b* from the sheet supplying portion 11 can be nipped between the nip roller 4 and the outer peripheral face 8*a*. Since the nip roller 4 is opposed to the lower roller 45, the nipped print sheet is pressed against the outer peripheral face 8*a* of the transport belt 8. When the nip-roller support plate 52 is swung from the state shown in FIG. 1 in a clockwise direction in FIG. 1 the nip roller 4 is separated from the outer peripheral face 8*a* of the transport belt 8. In this way, the nip-roller support plate 52 moves the nip roller 4 between the position where the nip roller is in contact with the outer peripheral face 8*a* of the transport belt 8 at the nip position A, and that where the nip roller is separate from the outer peripheral.

The nip-roller interlocking mechanism 53 interlockingly moves the head unit moving mechanism 51 and the nip-roller support plate 52. The nip-roller interlocking mechanism 53 has a pair of nip-roller link arms 56, and a pair of nip-roller urging springs (nip-roller urging unit) 57. The nip-roller link arms 56 are placed so that their surfaces are parallel to those of the side walls 52*b* of the nip-roller support plate 52. The nip-roller link arms 56 are swingably supported by a shaft 18*a* through which the pair of upper frames 18 are coupled to each other. The shaft 18*a* extends in the width direction of the transport belt 8. One end (the left end in FIG. 1) of each of the nip-roller link arms 56 is coupled to the head unit 30, and the other end (the right end in FIG. 1) is coupled to one end (the upper end in FIG. 1) of the corresponding one of the nip-roller urging springs 57. The other end (the lower end in FIG. 1) of each of the nip-roller urging springs 57 is coupled to one end (the right end in FIG. 1) of the corresponding one of the side walls 52*b*. The nip-roller urging springs 57 are accommodated in rectangular tubular spacers 57*a*. Therefore, the nip-roller urging springs 57 are not compressed to the total length of the spacers 57*a* or less.

The blade support plate 54 is a planar member configured by a rectangular main portion 54*a*, and two small protrusions 54*b* which are connected respectively to the both ends of the main portion 54*a* in the width direction of the belt so as to be placed perpendicular to the main portion 54*a*. A circular through hole is formed in each of the protrusions 54*b*. A shaft 17*b*, through which the pair of lower frames 17 are coupled with each other, is inserted into the through holes. Therefore, the blade support plate 54 is swingable with respect to the shaft 17*b*. A blade 31 having a length which is substantially equal to the width of the transport belt 8 is attached to one end in the short direction of the main portion 54*a*. The blade 31 is configured by a rectangular rubber sheet.

In the state shown in FIG. 1, the blade 31 is in contact with the outer peripheral face 8*a* of the transport belt 8 at a wiping position C (which is slightly down stream of an application position 8 described later, in the travel direction of the transport belt 8, and at which the transport belt 8 is nipped by the blade and the belt roller 6). When the blade support plate 54 is swing from the state shown in FIG. 1 in a clockwise direction in FIG. 1 by a predetermined angle or more, the blade 31 is separated from the outer peripheral face 8*a* of the transport belt 8. In this way, the blade support plate 54 moves the blade 31 between the position where the blade is in contact with the outer peripheral face 8*a* of the transport belt 8 at the wiping position C, and that where the blade is separate from the outer peripheral face 8*a* of the transport belt 8. When the one end in the short direction of the blade 31 is contacted with the outer peripheral face 8*a* of the transport belt 8, the one end scrapes off cleaning fluid, inks, and the like which adhere to the outer peripheral face 8*a* of the transport belt 8. The scraped cleaning fluid, inks, and the like flow into a disposal tray (not shown), which is disposed below the blade 31.

The blade interlocking mechanism 55 interlockingly moves the head unit moving mechanism 91 and the blade support plate 54. The blade interlocking mechanism 55 has a pair of blade link arms 58, and a pair of blade urging springs (blade urging unit) 59. The blade link arms 58 are placed so that their surfaces are parallel to those of the protrusions 54*b* of the blade support plate 54. The blade link arms 58 are swingably supported by a shaft 18*b* through which the pair of upper frames 18 are coupled to each other. The shaft 18*b* extends in the width direction of the transport belt 8. One end (the right end in FIG. 1) of each of the blade link arms 58 is coupled to the head unit 30, and the other end (the left end in FIG. 1) is coupled to one end (the upper end in FIG. 1) of the corresponding one of the blade urging springs 59. The other end (the lower end in FIG. 1) of each of the blade urging springs 59 is coupled to the middle of a corresponding end portion of the blade support plate 54. The blade urging springs 59 are accommodated in rectangular tubular spacers 59*a* the total length of which is shorter than the natural length of the blade urging springs 59. Therefore, the blade urging springs 59 are not compressed to the total length of the spacers 59*a* or less.

Figure 3:
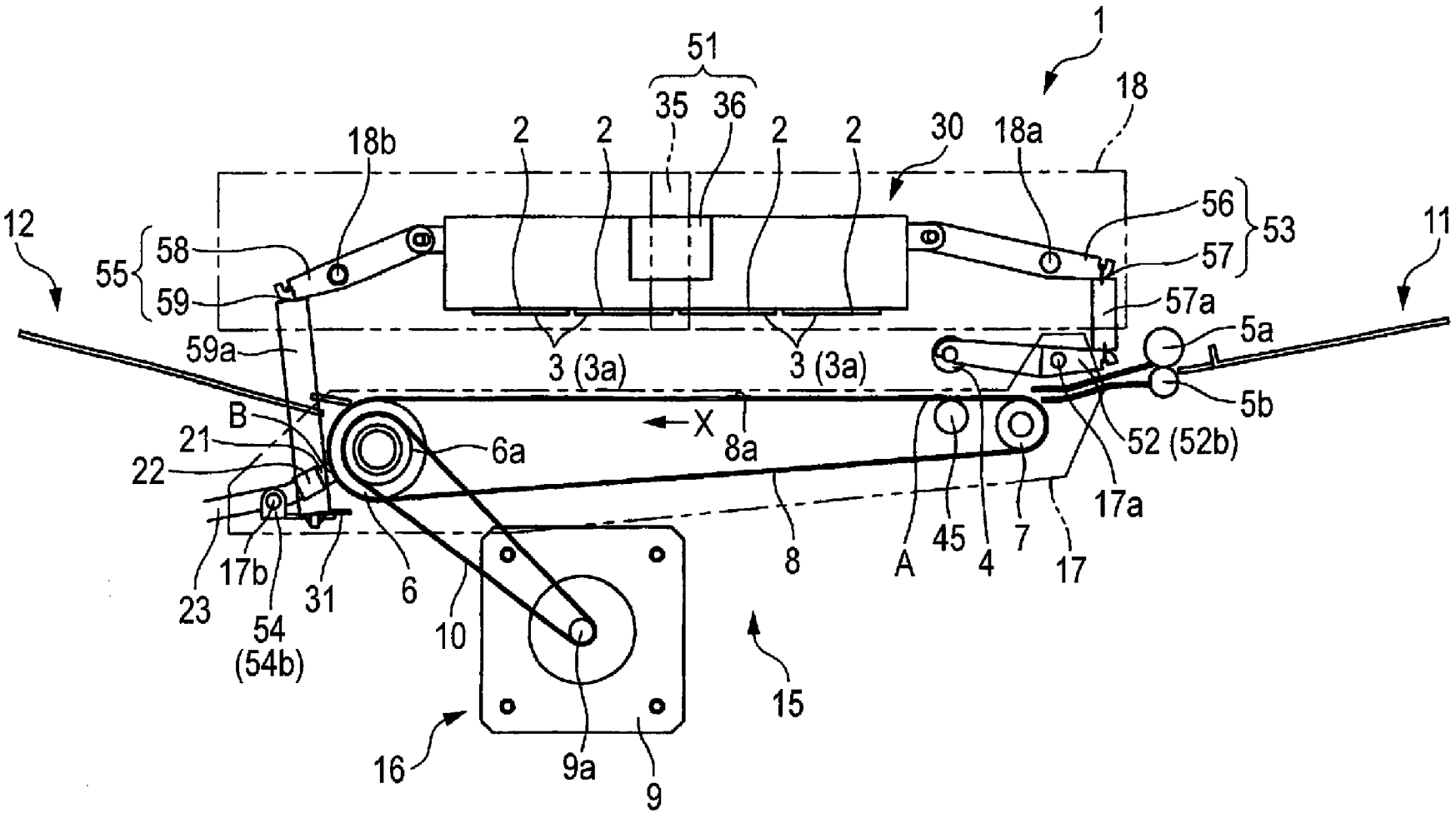
FIG. 3 is a side view illustrating the operation of the inkjet printer shown in FIG. 1.
Figure 4:
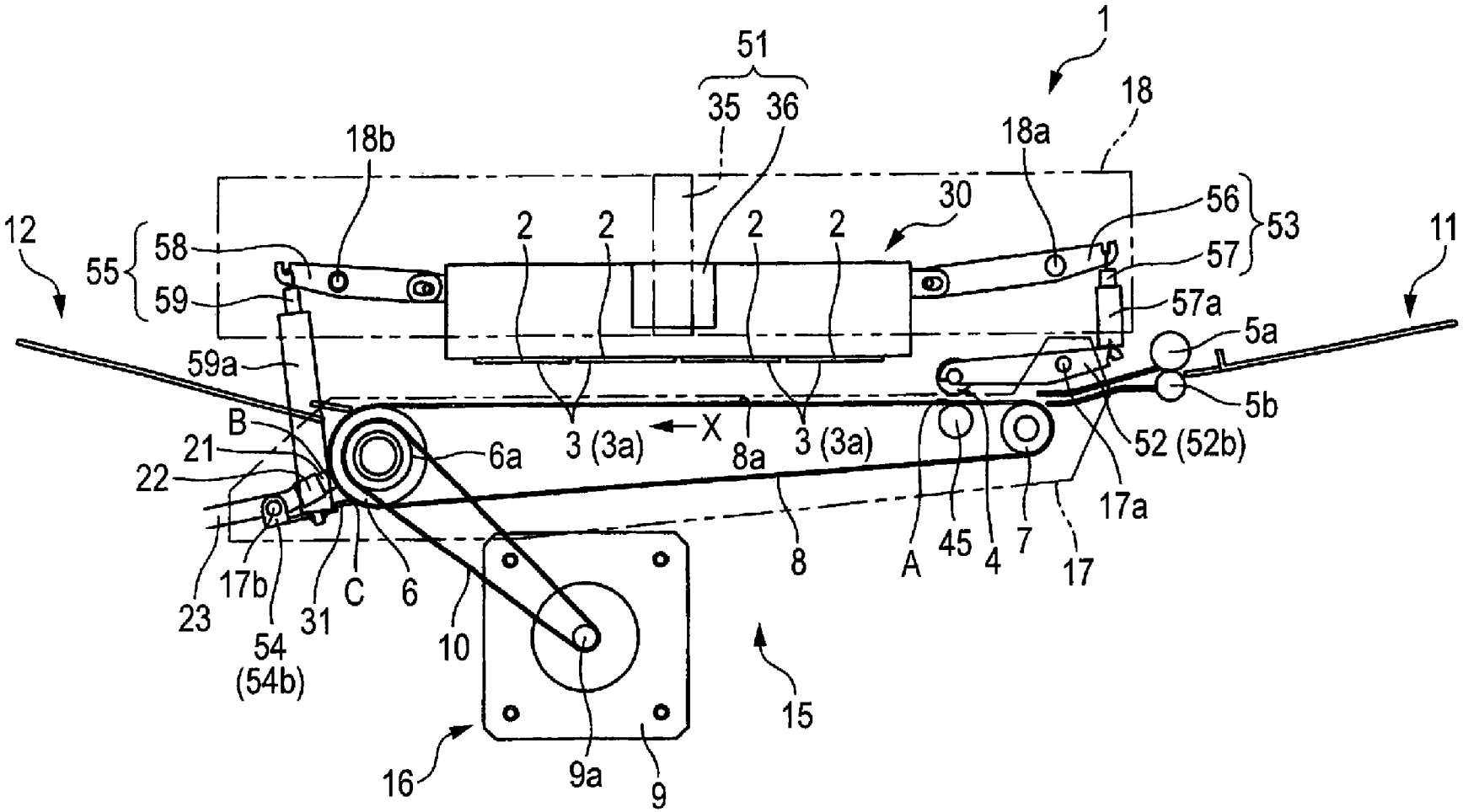
FIG. 4 is a side view illustrating the operation of the inkjet printer shown in FIG. 1.

The operations of the head unit moving mechanism 51, the nip-roller interlocking mechanism 53, and the blade interlocking mechanism 55 will be described in detail with reference to FIGS. 1, 3, and 4. FIG. 3 is a schematic side view showing the configuration of the inkjet printer 1 in the case where the head unit 30 is in "retracted state", and FIG. 4 is a schematic side view showing the configuration of the inkjet printer 1 in the case where the head unit 30 is in "intermediate state" between "recording-enabled state" and "retracted state". When the head unit moving mechanism 51 sets the head unit 30 to "recording-enabled state", as shown in FIG. 1, the left ends of the nip-roller link arms 56 are lower in level than the right ends, and the nip-roller urging springs 57 are pulled up together with the spacers 57*a* while being extended. Moreover, the left end of the nip-roller support plate 52 is lower in level than the right end, and the nip roller 4 is in contact with the outer peripheral face 8*a* of the transport belt 8 at the nip position A. At this time, since the nip-roller urging springs 57 are extended, the nip-roller support plate 52 is urged in a direction of swinging about the shaft 17*a* in a counterclockwise direction in FIG. 1, and the nip roller 4 is pressed by the urging force against the outer peripheral face 8*a*. On the other hand, the right ends of the blade link arms 58 are lower in level than the left ends, and the blade urging springs 59 are pulled up together with the spacers 59*a* while being extended. The right end of the blade support plate 54 is pulled up by the blade urging springs 59 to be higher in level than the left end, and the blade 31 is in contact with the outer peripheral face 8*a* of the transport belt 8 at the wiping position C. At this time, since the blade urging springs 59 are extended, the blade support plate 54 is urged in a direction of swinging about the shaft 17*b* in a counterclockwise direction in FIG. 1, and the blade 31 is pressed by the urging force against the outer peripheral face 8*a*.

When the head unit moving mechanism 51 sets the head unit 30 to "retracted state", as shown in FIG. 3, the right ends of the nip-roller link arms 56 are lower in level than the left ends and the nip-roller urging springs 57 are pushed down together with the spacers 57*a* while being compressed to the same length as the spacers 57*a*. The vicinity of the right end of the nip-roller support plate 52 is pushed down by contacting with the spacers 57*a*. Therefore, the left end of the nip-roller support plate 52 is higher in level than the right end, and the nip roller 4 is separated from the outer peripheral face 8*a* of the transport belt 8. On the other hand, the right ends of the blade link arms 58 are higher in level than the left ends, and the blade urging springs 59 are pushed down together with the spacers 59*a* while being compressed to the same length as the spacers 59*a*. The vicinity of the right end of the blade support plate 54 is pushed down by contacting with the spacers 59*a*. Therefore, the right and left ends of the blade support plate 54 are at an approximately same level, and the blade 31 is separated from the outer peripheral face 8*a* of the transport belt 8.

As shown in FIG. 4, when the head unit 30 is in "intermediate state" between "recording-enabled state" and "retracted state", the head unit 30 is at a level which is approximately intermediate between "recording-enabled state" and "retracted state". At this time, the right and left ends of the nip-roller link arms 56 are at an approximately same level, and the nip-roller urging springs 57 are slightly pulled up together with the spacers 57*a* from the retracted state of FIG. 3 while being slightly extended. Since the spacers 57*a* are slightly pulled up, the vicinity of the right end of the nip-roller support plate 52 is slightly pulled up from the retracted state of FIG. 3. The right and left ends of the nip-roller support plate 52 are at an approximately same level, and the nip roller 4 is separate from the outer peripheral face 8*a* of the transport belts. The separation amount in this case is smaller than that of the retracted state of FIG. 3. On the other hand, the right and left ends of the blade link arms 58 are at an approximately same level, and the blade urging springs 59 are pulled up together with the spacers 59*a* while being extended. The right end of the blade support plate 54 is pulled up by the blade urging springs 59 to be higher in level than the left end, and the blade 31 is in contact with the outer peripheral face 5*a* of the transport belt 8 at the wiping position C. At this time, since the blade urging springs 59 are extended, the blade support plate 54 is urged in the direction of swinging about the shaft 17*b* in a counterclockwise direction in FIG. 1, and the blade 31 is pressed by the urging force against the outer peripheral face 8*a*. Namely, the blade urging springs 59 and the blade support plate 54 are at approximately same positions as those of the retracted state of FIG. 3.

As described above, the nip-roller interlocking mechanism 53 interlocks the operation of the head unit moving mechanism 51 with that of the nip-roller support plate 52, and the blade interlocking mechanism 55 interlocks the operation of the head unit moving mechanism 51 with that of the blade support plate 54. When the head unit 30 is in "recording-enabled state", the nip roller 4 and the blade 31 are in contact with the outer peripheral face 8*a* of the transport belt 8. When the head unit 30 is in "retracted state", the nip roller 4 and the blade 31 are separate from the outer peripheral face 8*a* of the transport belt 8. When the head unit 30 is in "intermediate state", the nip roller 4 is separate from the outer peripheral face 8*a* of the transport belt 8, and the blade 31 is in contact with the outer peripheral face 8*a* of the transport belt 8. In the process in which the head unit 30 is transferred from "retracted state" to "recording-enabled state" via "intermediate state", the blade 31 is contacted with the outer peripheral face 8*a* of the transport belt 8, and then the nip roller 4 is contacted with the outer peripheral face 8*a* of the transport belt 8.

As shown FIG. 1, an absorbing member (applying unit) 21 is placed at a lower left position of the belt roller 6 so that the transport belt 8 is nipped between the absorbing member and the belt roller 6 at the application position B (which exists in the range from the ink receiving position due to the inkjet head 2 to the nip position A along the travel direction of the transport belt 8), and the absorbing member is always in contact with the whole area in the width direction of the outer peripheral face 8*a* of the transport belt 8. The absorbing member 21 absorbs cleaning fluid, which is supplied as described later, and applies it to the outer peripheral face 8*a* of the transport belt 8.

Figure 5:
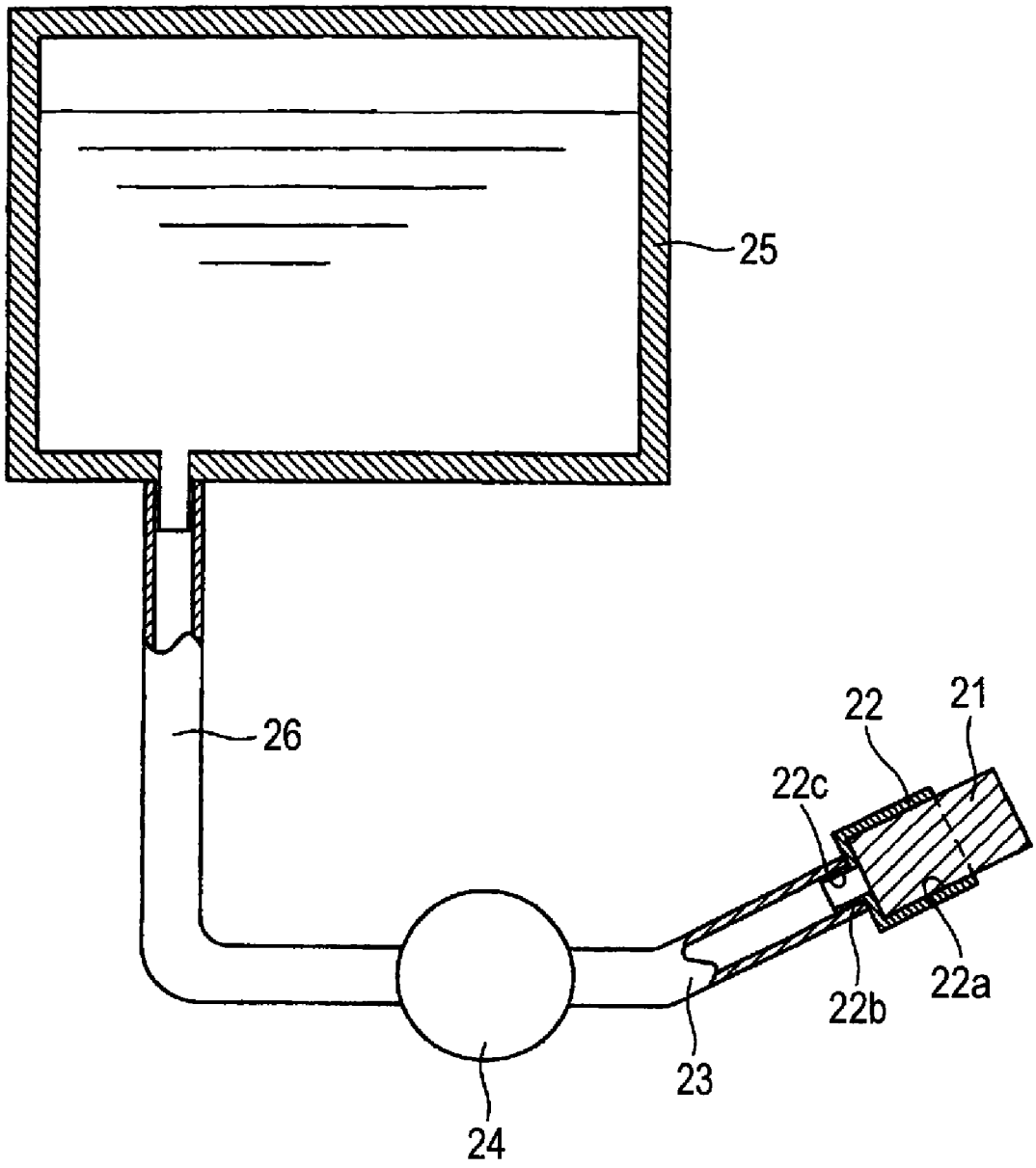
FIG. 5 is a diagram of a configuration for supplying cleaning fluid to an absorbing member shown in FIG. 1.

Next, a configuration for supplying the cleaning fluid to the absorbing member 21 will be described. FIG. 5 is a diagram showing the configuration for supplying the cleaning fluid to the absorbing member 21 shown in FIG. 1. As shown in FIG. 5, the absorbing member 21 is housed in a case 22 in which a recess 22*a* is formed, in such a manner that a tip end portion of the member is exposed. The absorbing member 21 has a parallelepiped shape the longitudinal direction of which coincides with the direction perpendicular to the plane of the paper in FIG. 5, and the width in the longitudinal direction is substantially equal to that of the transport belt 8. The absorbing member 21 in this aspect is formed by a soft sponge having open cells. The absorbing member 21 may be formed by any product such as a felt other than a sponge, as far as it can absorb liquid and continuously apply the absorbed liquid to a face with which it is in contact. A connecting portion 22*b*, which is projected in the lower-leftward direction in FIG. 5, is formed in a bottom portion of the case 22. One end of a flexible tube 23 is connected to the connecting portion 22*b*, and the recess 22*a* and the tube 23 communicate with each other through a communication hole 22*c* formed in the connecting portion 22*b*. An on-off valve 24 is connected to the other end of the tube 23. A tube 26, which is connected to a tank 25 filled with the cleaning fluid, is connected to the on-off valve 24. The tank 25 is placed at a level higher than the position of the absorbing member 21. According to the configuration, the whole amount of the cleaning fluid in the tank 25 can be supplied to the absorbing member 21 by using the water head difference with respect to the absorbing member 21.

In the configuration for supplying the cleaning fluid, when the on-off valve 24 is set to "on state" in response to a command from the controlling section 60, the cleaning fluid in the tank 25 is supplied to the absorbing member 21 through the tube 26, the on-off valve 24, the tube 23, and the case 22. By contrast, when the on-off valve 24 is set to "off state" in response to a command from the controlling section 60, the supply of the cleaning fluid to the absorbing member 21 is stopped.

Figure 6:
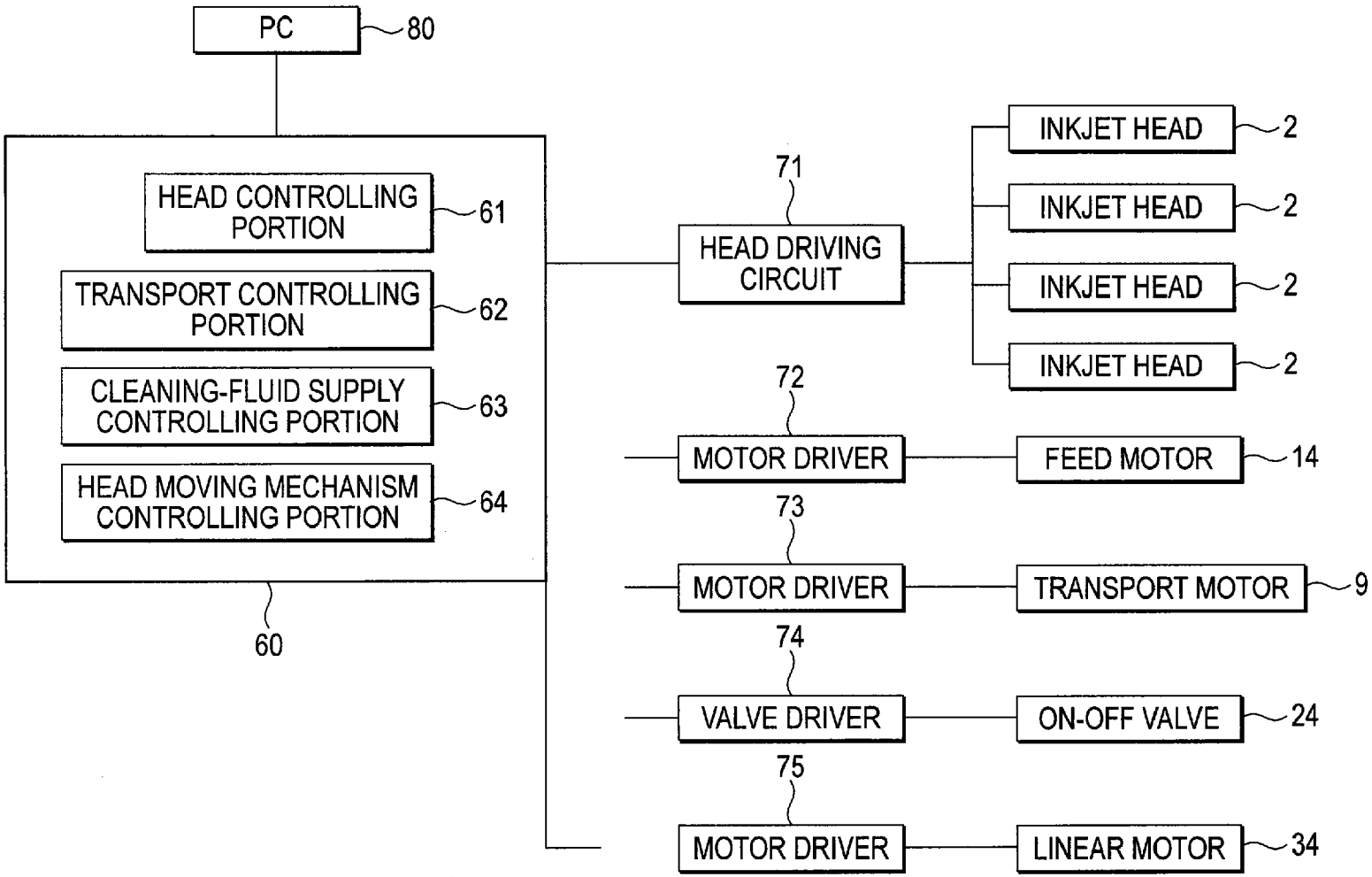
FIG. 6 is a schematic block diagram showing a configuration for controlling the inkjet printer.

Next, a control system of the inkjet printer 1 will be described with reference to FIG. 6. FIG. 6 is a schematic block diagram showing a configuration for controlling the inkjet printer 1. The controlling section 60 included in the inkjet printer 1 is configured by: a CPU (Central Processing Unit) which is an arithmetic processing unit; a ROM (Read Only Memory) which stores programs to be executed by the CPU, and data to be used by the programs; and a RAM (Random Access Memory) which temporarily stores data during execution of a program. As shown in FIG. 6, the controlling section includes a head controlling portion 61, a transport controlling portion (travel controlling means) 62, a cleaning-fluid supply controlling portion 63, and a head moving mechanism controlling portion (including nip-roller movement controlling means) 64. A head driving circuit 71, motor drivers 72, 73, 75, and a valve driver 74 are connected to the controlling section 60.

The head driving circuit 71 drive-controls the ink ejection from the inkjet head 2 in accordance with a command from the controlling section 60. The motor driver 72 drive-controls the feed motor 14 in accordance with a command from the controlling section 60. The motor driver 73 drive-controls the transport motor 9 in accordance with a command from the controlling section 60. The valve driver 74 on/off-controls the on-off valve 24 in accordance with a command from the controlling section 60. The motor driver 75 drive-controls the linear motor 36 in accordance with a command from the controlling section 60.

When the controlling section 60 receives a print signal from a PC (Personal Computer) 80, the head controlling portion 61 confirms that the head unit 30 is in "recording-enabled state" (see FIG. 1), and thereafter controls the head driving circuit 71 so that the corresponding inkjet head 2 ejects the ink.

When the controlling section 60 receives the print signal from the PC 80, the transport controlling portion 62 confirms that the head unit 30 is in "intermediate state" (see FIG. 4), i.e., that the nip roller 4 is separate from the outer peripheral face 8*a* of the transport belt 8 and the blade 31 is in contact with the outer peripheral face 8*a* of the transport belt 8, and thereafter controls the motor driver 173 so as to drive the transport motor 9 so that the transport belt 8 travels in the sheet transportation direction. Then, after the transport belt 8 starts to travel, the initial contact place (initially positioned at the wiping position C) where the blade 31 is initially in contact with the outer peripheral face 8*a* of the transport belt 8 passes the nip position A. After it is confirmed that the head unit 30 is transferred from "intermediate state" to "recording-enabled state", i.e., that the nip roller 4 and the blade 31 are in contact with the outer peripheral face 8*a* of the transport belt 8, the motor driver 72 is controlled so as to drive the feed motor 14 so that the both feed rollers 8*a*, 5*b* are rotated to supply the print sheet onto the transport belt 8. When the transport belt 8 is traveled in the case of maintenance of the inkjet printer 1 or the like, it is confirmed that the head unit 30 is in "retracted state" (see FIG. 3), i.e., that the nip roller 4 and the blade 31 are separate from the outer peripheral face 8*a* of the transport belt 8, and thereafter the motor driver 73 is controlled so as to drive the transport motor 9 so that the transport belt 8 travels in the sheet transportation direction.

When the controlling section 60 receives the print signal from the PC 80, the cleaning-fluid supply controlling portion 63 controls the valve driver 74 so that the on-off valve 24 is changed from "off state" to "on state". As a result, the cleaning fluid is supplied to the absorbing member 21 before the transport controlling portion 62 causes the transport belt 8 to travel. The head moving mechanism controlling portion 64 controls the motor driver 75 so that the head unit 30 can take "recording-enabled state", "intermediate state", or "retracted state". When the inkjet printer 1 is in a waiting state or a maintenance state, the portion controls the motor driver 75 so that the head unit 30 takes "retracted state". When the controlling section 60 receives the print signal from the PC 80, the portion controls the motor driver 75 so that the head unit 30 is transferred from "retracted state" to "to intermediate state". Then, it is confirmed, after the transport belt 8 starts to travel, that the initial contact place where the blade 31 is initially in contact with the outer peripheral face 8*a* of the transport belt 8 passes the nip position A. Thereafter, the portion controls the motor driver 75 so that the head unit 30 is transferred to "recording-enabled state". The check whether the place where the blade 31 is initially in contact with the outer peripheral face 8*a* of the transport belt 8 passes the nip position A or not may be conducted by monitoring the rotation number of the transport motor 9, or by monitoring the driving time of the transport motor 9.

Figure 7A:
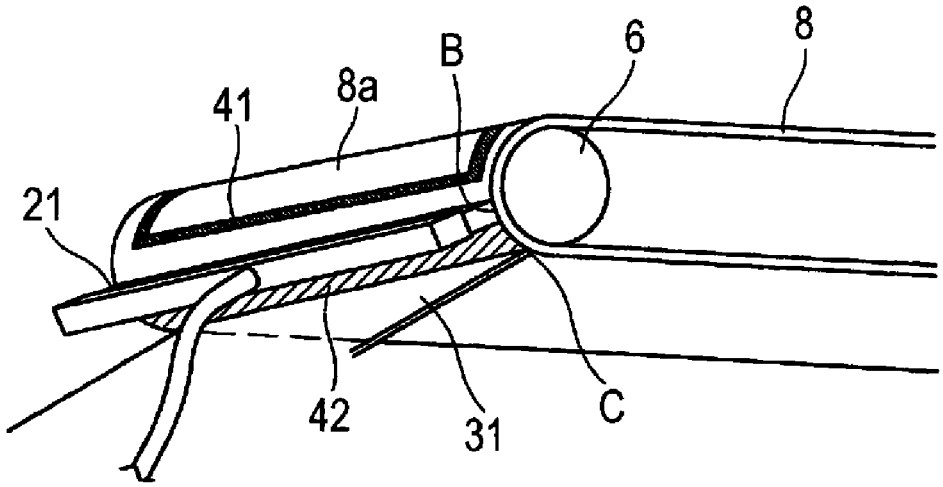
FIGS. 7A and 7B are diagrams showing operating statuses in a cleaning process on a transport belt of the inkjet printer shown in FIG. 1.
Figure 7B:
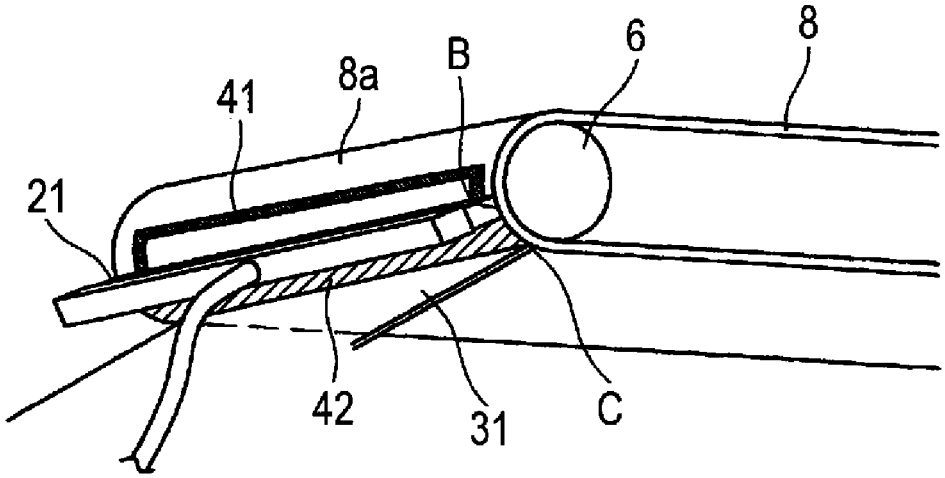

Next, a cleaning operation in which, in the case such as that borderless printing is performed on the print sheet, inks adhering onto the transport belt 8 is cleaned by the absorbing member 21 absorbing the cleaning fluid, and the blade 31 will be described with reference to FIGS. 7A and 7B. FIGS. 7A and, 7B are diagrams showing operating statuses in the cleaning process on the transport belt of the inkjet printer of this aspect. When borderless printing is performed by ejecting inks from the inkjet head 2 so that the inks adhere to the whole print face of the print sheet a perimeter-shaped ink adhering area 41 is formed on the outer peripheral face 8*a* of the transport belt 8 as a result of adherence of the inks along the outer periphery of the print sheet as shown in FIG. 7A. On the outer peripheral face 8*a* of the transport belt 8, a cleaning-fluid applied area 42 to which the cleaning fluid is applied from the absorbing member 21 as a result of traveling of the transport belt 8 is formed between a place which is contacted with the absorbing member 21 and a place which is contacted with the blade 31.

As described above, on the outer peripheral face 5*a* of the transport belt 8, the cleaning-fluid applied area 42 is formed as a result of traveling of the transport belt 8. When the ink adhering area 41 enters between the absorbing member 21 and the blade 31 in accordance with traveling of the transport belt 8 as shown in FIG. 7B, the inks forming the ink adhering area 41, and the cleaning fluid in the cleaning-fluid applied area 42 remain on the outer peripheral face 8*a* of the transport belt 8 in a mixed state (the inks of the ink adhering area 41 dissolve in the cleaning fluid of the cleaning-fluid applied area 42). At this time, the amount the cleaning fluid of the cleaning-fluid applied area 42 per unit area is several to several tens of times the amount of the inks of the ink adhering area 41. The inks of the ink adhering area 41 which are diluted with the large amount of cleaning fluid in this way are scraped together with the cleaning fluid by the blade 31 in accordance with traveling of the transport belt 8. Namely, the inks and the cleaning fluid little adhere to the downstream of the place where the transport belt 8 and the blade 31 are in contact with each other. When the transport belt 8 further travels and a new print sheet adheres onto the face from which the cleaning fluid and the inks have been scraped off by the blade 31, therefore, the cleaning fluid and the inks do not adhere to the new print sheet. In this case, the scraped cleaning fluid and inks accumulate in a gap between the blade 31 and the outer peripheral face 8*a* of the transport belt 8.

When the travel of the transport belt 8 in the printing process is stopped, or when the transport belt 8 at rest restarts to travel, however, the transport belt 8 vibrates due to, for example, rattling of the belt rollers 6, 7, and the cleaning fluid and inks which accumulate in the gap between the blade 31 and the outer peripheral face 8*a* of the transport belt 8 sometimes leak through the gap toward the downstream side in the travel direction of the transport belt 8, and adhere to the outer peripheral face 8*a*. Also in this case, according to the inkjet printer 1, when the transport belt 8 starts to travel, the nip roller 4 is not contacted with the outer peripheral face 8*a* until the initial contact place where the blade 31 is initially in contact with the outer peripheral face 8*a* of the transport belt 8 passes the nip position A. Therefore, the cleaning fluid and inks, which adhere to the outer peripheral face 8*a*, do not adhere to the nip roller 4 in the initial contact place between the outer peripheral face 8*a* and the blade 31. Accordingly, the cleaning fluid and the inks are prevented from adhering to the print sheet through the nip roller 4.

At the application position B which is between the ink receiving position due to the inkjet head 2 and the nip position A in the travel direction of the transport belt 8, the absorbing member 21 applies the cleaning fluid to the outer peripheral face 8*a* of the transport belt 8, and, at the wiping position C which is between the application position B and the nip position A in the travel direction of the transport belt 8, the blade 31 scrapes off the cleaning fluid and inks which adhere to the outer peripheral face 8*a* of the transport belt 8. Therefore, the cleaning fluid from the absorbing member 21 is not applied to the ink receiving position. Accordingly, the cleaning fluid hardly adheres to the print sheet.

When the head unit moving mechanism 51 sets the head unit 30 to "retracted state", the space between the head unit 30 and the transport belt 8 can be widened. Therefore, maintenance of the inkjet printer 1 is facilitated.

Moreover, the nip-roller interlocking mechanism 53 interlocks the operation of the head unit moving mechanism 51, with that of the nip-roller support plate 52, the nip roller 4 is contacted with the outer peripheral face 8*a* of the transport belt 8 when the head moving mechanism controlling portion 64 sets the head unit 30 to "recording-enabled state", and separated from the outer peripheral face 8*a* of the transport belt 8 when the head unit 30 is set to "retracted state". According to the configuration, additional driving source for swinging the hip-roller support plate 52 is not required, and hence the configuration of the apparatus can be simplified.

The nip-roller interlocking mechanism 53 has the nip-roller urging springs 57 for urging the nip roller 4 against the outer peripheral face 5*a* of the transport belt 8. Therefore, the nip roller 4 can efficiently press the print sheet against the outer peripheral face 5*a* of the transport belt 8.

Moreover, the blade interlocking mechanism 55 interlocks the operation of the head unit moving mechanism 51 with that of the blade support plate 54. The blade 31 is contacted with the outer peripheral face 8*a* of the transport belt 8 when the head moving mechanism controlling portion 64 sets the head unit 30 to "recording-enabled state", and separated from the outer peripheral face 8*a* of the transport belt 8 when the head unit 30 is set to "retracted state". According to the configuration, additional driving source for swinging the blade support plate 54 is not required, and hence the configuration of the apparatus can be simplified.

In the process in which the head unit 30 is transferred from "retracted state" to "recording-enabled state" via "intermediate state", the blade 31 is contacted with the outer peripheral face 8*a* of the transport belt 8, and then the nip roller 4 is contacted with the outer peripheral face 8*a* of the transport belt 8. While the nip roller 4 is separated from the outer peripheral face 8*a* of the transport belt 8, therefore, only the blade 31 can be moved between the position where it is in contact at the wiping position C with the outer peripheral face 8*a* of the transport belt 8, and the position where it is separate from the outer peripheral face 8*a* of the transport belt 8. According to the configuration, while the blade 31 is separated from the outer peripheral face 8*a* of the transport belt 8, the transport belt 8 can travel in a direction opposite to the transportation direction of the print sheet, or only the blade 31 is contacted with the outer peripheral face 8*a* to clean the outer peripheral face 8*a* of the transport belt 8. Accordingly, the maintainability of the inkjet printer 1 is further improved.

Since the blade interlocking mechanism 55 has the blade urging springs 59 for urging the blade 31 against the outer peripheral face 8*a* of the transport belt 8, the blade 31 can be efficiently pressed against the outer peripheral face. Therefore, the cleaning fluid and inks which adhere to the outer peripheral face 8*a* of the transport belt 8 hardly leak to the downstream of the blade 31 in the travel direction. Consequently, the print sheet is further prevented from being smeared.

In the printing processor the transport controlling portion 62 causes the transport belt 8 to travel after the blade 31 is contacted with the outer peripheral face 8*a* of the transport belt 8. Therefore, splashing of the cleaning fluid and inks which adhere to the blade 31 can be prevented from being caused by contacting the blade 31 with the traveling transport belt 8. Accordingly, the interior of the inkjet printer 1 is hardly contaminated.

Since the outer peripheral face 8*a* of the transport belt 8 is adhesive, the print sheet is surely held by the outer peripheral face 8*a* of the transport belt 8.

Second Aspect

Figure 8:
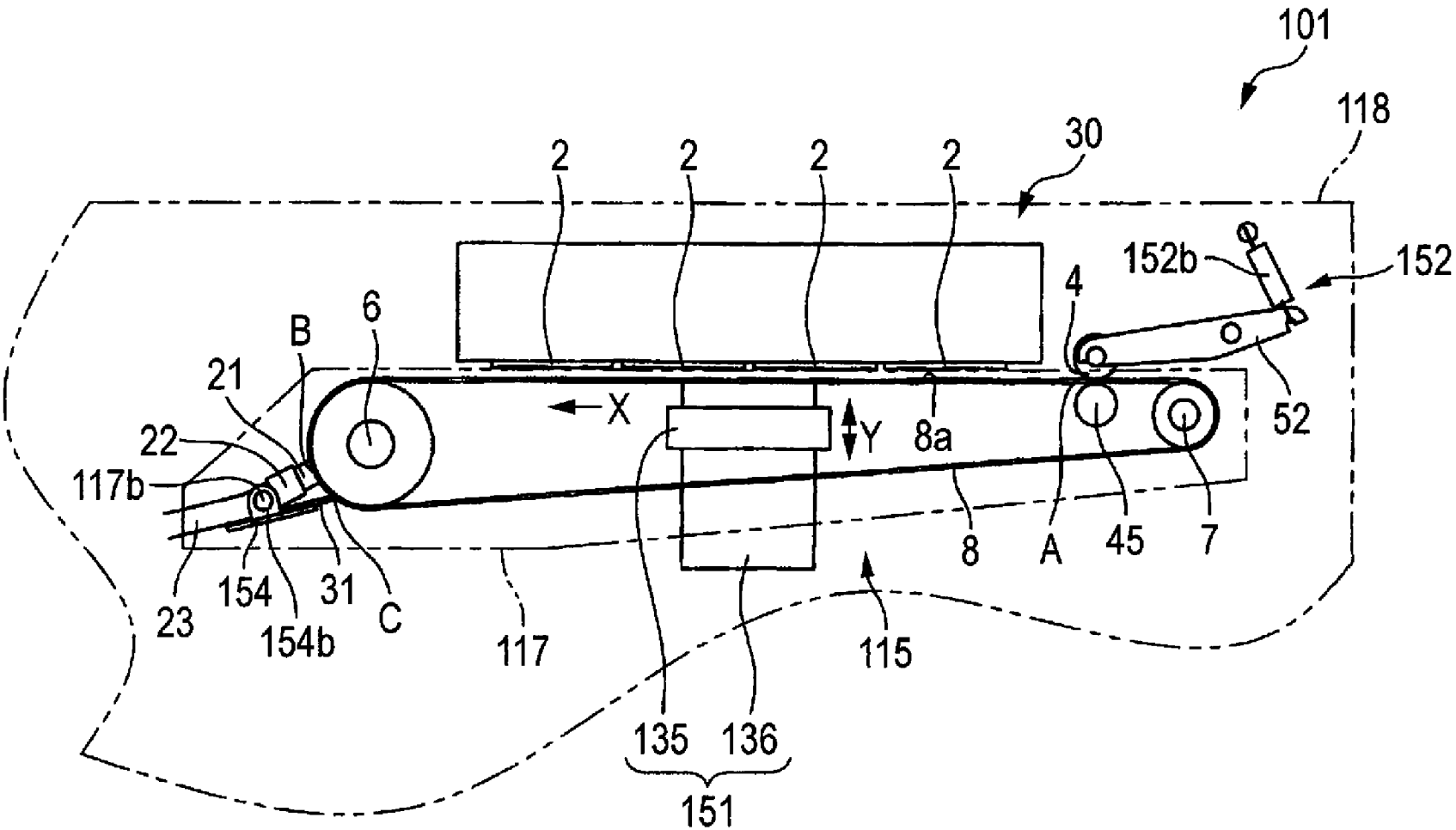
FIG. 8 is aside view showing the configuration of an inkjet printer according to a second aspect of the invention.

Next, an inkjet printer according to a second aspect will be described. The components, which are substantially identical with those of the first aspect, are denoted by the same reference numerals, and their description is omitted. FIG. 8 is a schematic side view showing the configuration of the inkjet printer according to the second aspect of the invention. In FIG. 8, only the intermediate portion of the sheet transporting path is shown. The inkjet printer 101 has the head unit 30, a belt transporting apparatus 115, a belt transporting apparatus moving mechanism (head moving mechanism) 151, a nip-roller supporting mechanism 152, the absorbing member 21, and a blade support plate 154. The inkjet printer 101 further has a controlling section 160 (see FIG. 10) for controlling the inkjet printer 101. The head unit 30 is fixed to a frame 118. The belt transporting apparatus 115 has the belt rollers 6, 7, the transport belt 8, the transport belt driving device 16, and a frame 117 which supports these components.

The belt transporting apparatus moving mechanism 151 raises 4 and lowers the belt transporting apparatus 115 in the direction of the arrow Y in FIG. 8. The belt transporting apparatus moving mechanism 151 has: a guide rail 135 which vertically extends on the inner side of the frame 118; and a linear motor 136 which is disposed on the frame 117 of the belt transporting apparatus 115. The linear motor 136 can travel along the guide rail 135. According to the configuration, the belt transporting apparatus moving mechanism 151 can relatively move the belt transporting apparatus 115 with respect to the head unit 30, so as to take "recording-enabled state" where the inkjet heads 2 are close to the transport belt 8, or "retracted state" where the inkjet heads are separate from the transport belt 8. The terms "recording-enabled state" and "retracted state" indicate relative positional relationships of the head unit 30 with respect to the belt transporting apparatus 115. FIG. 8 shows a state where the belt transporting apparatus moving mechanism 151 raises the belt transporting apparatus 115, whereby the head unit 30 is set to "recording-enabled state".

The nip-roller supporting mechanism 152 has the nip-roller support plate (nip-roller moving mechanism) 52, and a pair of urging springs 152*b*. The nip-roller support plate 52 is swingably supported by the frame 118. The nip roller 4 is rotatably supported by one end (the left end in the figure) of the nip-roller support plate 52. The nip roller 4 is placed so as to be opposed the lower roller 45 across the transport belt 8 in a state where the roller is supported by the nip-roller support plate 52. One end (the lower end in the figure) of each of the urging springs 152*b* is coupled to the other end (the right end in the figure) of the nip-roller support plate 52, and the other end (the left end in the figure) is coupled to the frame 118. The nip-roller support plate 52 is urged by the urging springs 152*b* so as to swing in a counterclockwise direction in the figure. According to the configuration, the nip roller 4 is pressed by the urging force against the outer peripheral face 8*a* of the transport belt 8.

The blade support plate 154 is a planar member configured by a rectangular main portion (not shown), and two small protrusions 154*b* which are connected respectively to the both ends of the main portion in the width direction of the belt so as to be placed perpendicular to the main portion. The small protrusions 154*b* are fixed to the frame 117 by fixing members 117*b*. Therefore, the blade support plate 154 does not swing. The blade 31 having a length which is substantially equal to the width of the transport belt 8 is attached to one end of the blade support plate 154. Accordingly, an end portion of the blade 31 in the short direction is always in contact with the outer peripheral face 8*a* of the transport belt 8.

Figure 9:
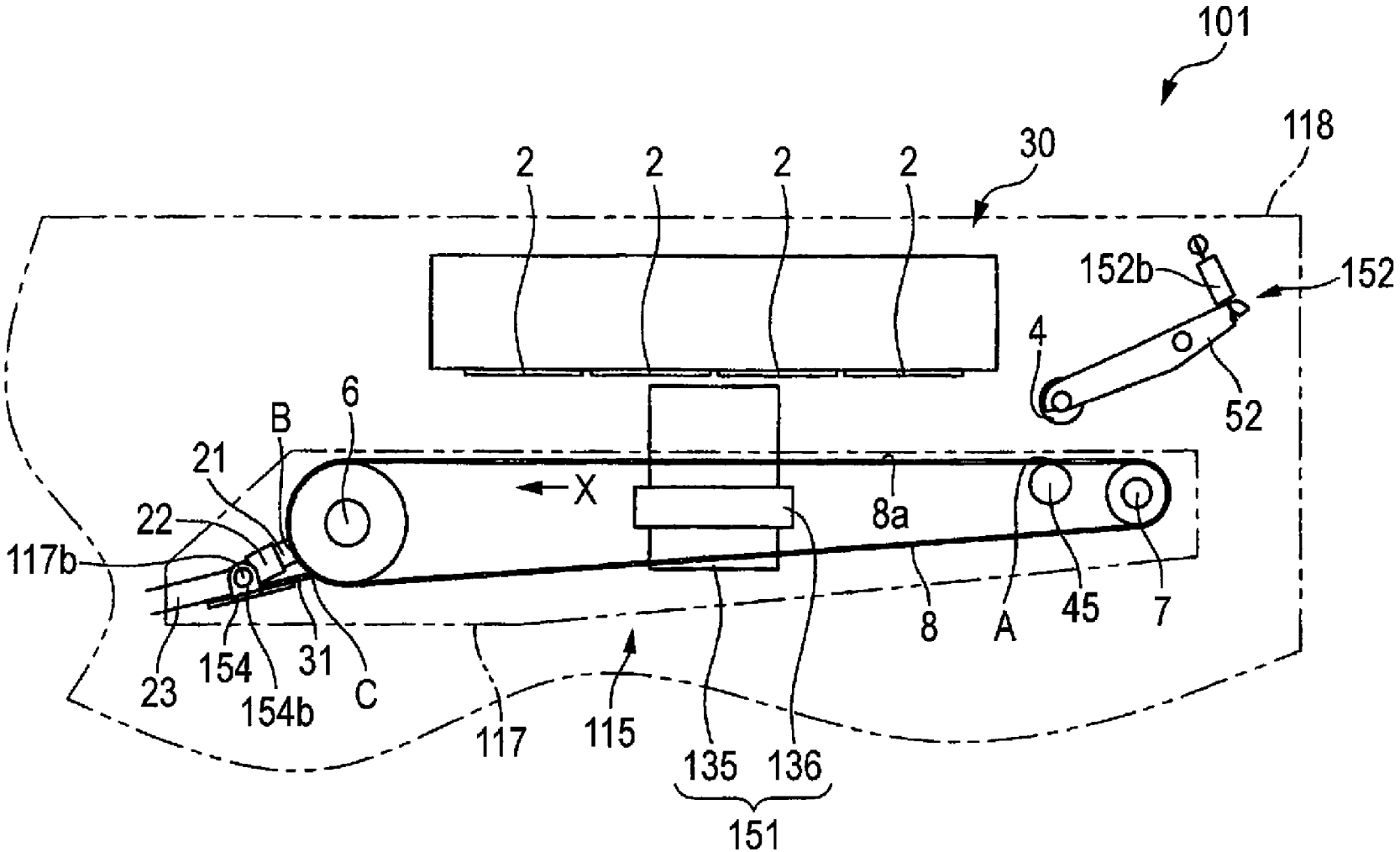
FIG. 9 is a side view illustrating the operation of the inkjet printer shown in FIG. 8.

Next, the operation of the inkjet printer 101 will be described with further reference to FIG. 9. FIG. 9 is a schematic side view showing the configuration of the inkjet printer 101 in the case where belt transporting apparatus moving mechanism 151 lowers the belt transporting apparatus 115, whereby the head unit 30 is set to "retracted state". As shown in FIG. 8, when the head unit 30 is in "recording-enabled state", the nip roller 4 and the outer peripheral face 8*a* of the transport belt 8 are in contact with each other at the nip position A. As shown in FIG. 9, when the head unit 30 is in "retracted state", the nip roller 4 is separate from the nip position A. In this way, the belt transporting apparatus moving mechanism 151 can relatively move the nip roller 4 between the position where the roller is in contact with the outer peripheral face 8*a* of the transport belt 8, and the position where the roller is separate from the face.

Figure 10:
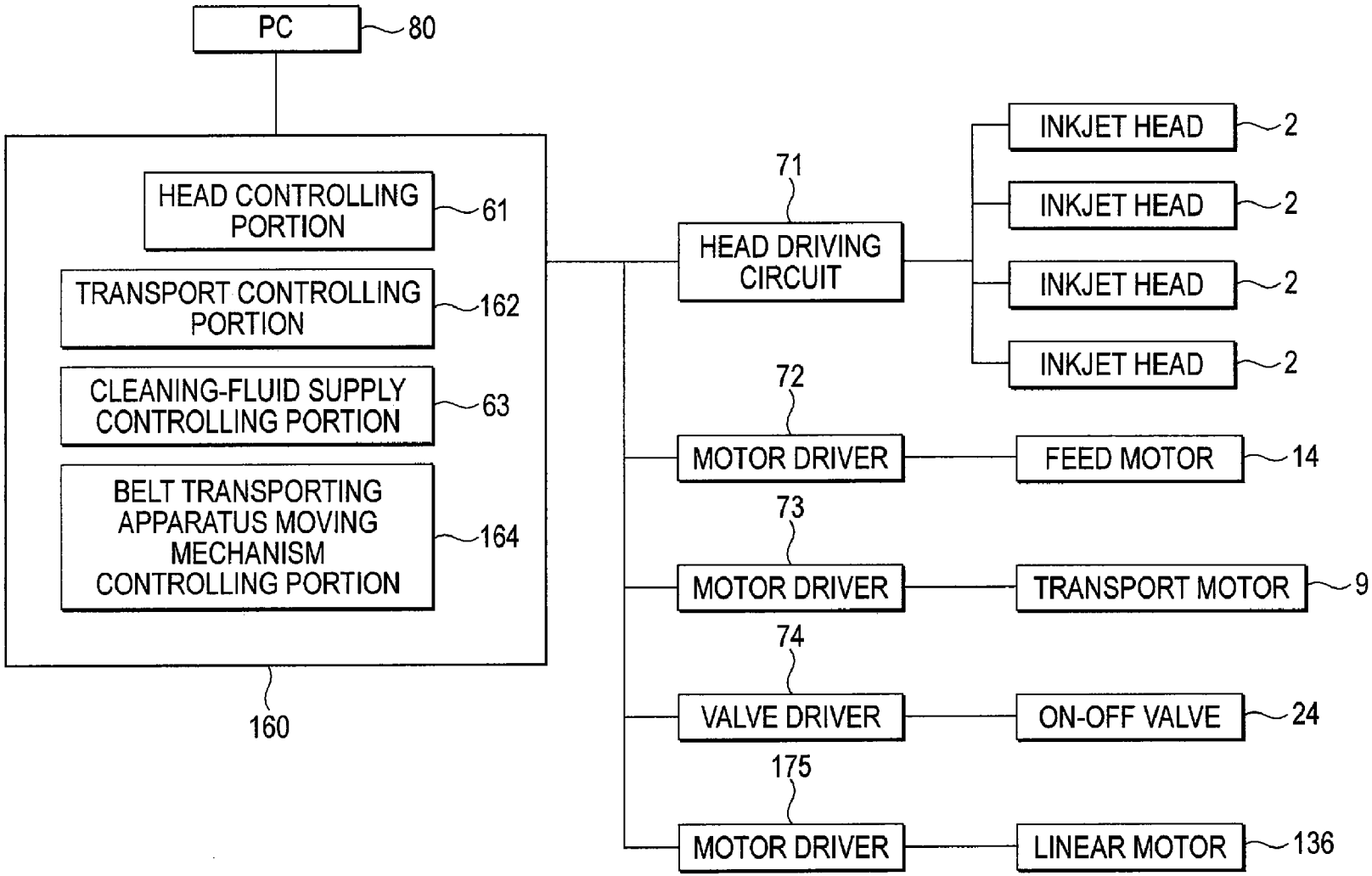
FIG. 10 is a schematic block diagram showing a configuration for controlling the inkjet printer.

Next, a control system of the inkjet printer 101 will be described with reference to FIG. 10. The components which are substantially identical with those of the control system of the first aspect are denoted by the same reference numerals, and their description is omitted. FIG. 10 is a schematic block diagram showing a configuration for controlling the inkjet printer 101. As shown in FIG. 10, a controlling section 160 included in the inkjet printer 101 comprises the head controlling portion 61, a transport controlling portion (travel controlling means) 162, the cleaning-fluid supply controlling portion 63, and a belt transporting apparatus moving mechanism controlling portion (including nip-roller movement controlling means) 164. The head driving circuit 71, the motor drivers 72, 73, 175, and the valve driver 74 are connected to the controlling section 160. The motor driver 175 drive-controls the linear motor 136 in accordance with a command from the controlling section 160.

When the controlling section 160 receives the print signal from the PC 80, the transport controlling portion 162 confirms that the head unit 30 is in "retracted state", i.e., that the nip roller 4 is separate from the outer peripheral face 8*a* of the transport belt 8, and the blade 31 is in contact with the outer peripheral face 8*a* of the transport belt 8, and thereafter controls the motor driver 73 so as to drive the transport motor 9 so that the transport belt 8 travels in the sheet transportation direction. Then, after the transport belt 8 starts to travel, the initial contact place (initially positioned at the wiping position C) where the blade 31 is initially in contact with the outer peripheral face 8*a* of the transport bolt 8 passes the nip position A. After it is then confirmed that the head unit 30 is transferred from "retracted state" to "recording-enabled state", i.e., that the nip roller 4 and the blade 31 are in contact with the outer peripheral face 8*a* of the transport belt 8, the motor driver 72 is controlled so as to drive the feed motor 14 so that the both feed rollers 5*a*, 8*b* are rotated to supply the print sheet onto the transport belt 8. When the transport belt 8 is traveled in the case of maintenance of the inkjet printer 101 or the like, it is confirmed that the head unit 30 is in "retracted state", and thereafter the motor driver 73 is controlled so as to drive the transport motor 9 so that the transport belt 8 travels in the sheet transportation direction.

The belt transporting apparatus moving mechanism controlling portion 164 controls the motor driver 175 so that the head unit 30 can take "recording-enabled state" (see FIG. 8) or "retracted state" (see FIG. 9), and raises or lowers the belt transporting apparatus 115. Specifically, when the inkjet printer 101 is in a waiting state, the portion controls the motor driver 175 so that that belt transporting apparatus moving mechanism 151 lowers the belt transporting apparatus 115, whereby the head unit 30 takes "retracted state". When the controlling section 160 receives the print signal from the PC 80, after the transport belt 8 starts to travel, the portion confirms that the initial contact place where the blade 31 is initially in contact with the outer peripheral face 8*a* of the transport belt 8 passes the nip position A, and thereafter controls the motor driver 175 so that belt transporting apparatus moving mechanism 151 raises the belt transporting apparatus 115, whereby the head unit 30 is set to "recording-enabled state".

As described above, according to the inkjet printer 101 of this aspect, even in the case where the cleaning fluid and inks which accumulate in the gap between the blade 31 and the outer peripheral face 8*a* of the transport belt 8 leak through the gap toward the downstream side in the travel direction of the transport belt 8 to adhere to the outer peripheral face 8*a*, when the transport belt 8 starts to travel, the nip roller 4 is not contacted with the outer peripheral face 8*a* until the initial contact place where the blade 31 is initially in contact with the outer peripheral face 8*a* of the transport belt 8 passes the nip position A. Therefore, the cleaning fluid and inks which adhere to the outer peripheral face 8*a* do not adhere to the nip roller 4 in the initial contact place with respect to the blade 31. Accordingly, the cleaning fluid and the inks are prevented from adhering to the print sheet via the nip roller 4.

The belt transporting apparatus moving mechanism 151 raises and lowers the belt transporting apparatus 115, so that the flip roller 4 can move between the position where the roller is in contact with the outer peripheral face 5*a* of the transport belt 8, and that where the roller is separate from the outer peripheral face. Therefore, additional driving source for swinging the nip-roller support plate 52 is not reclined, and hence the configuration of the apparatus can be simplified.

Although the aspects of the invention have been described, the invention is not restricted to the above-described aspects, and various modifications may be made without departing from the scope of the invention. For Example, the above-described inkjet printer 1 of the first aspect is configured so that, when the inkjet printer 1 is in a waiting state or a maintenance state, the head unit 30 is set to "retracted state" where the head unit 30 is separate from the transport belt 8. Alternatively, the apparatus may be configured so that, when at the start of the printing process the nip roller 4 can be separated from the transport belt 8, the head unit 30 is not set to "retracted state".

In the above-described first aspect, the nip-roller interlocking mechanism 53 interlocks the operation of the head unit moving mechanism 51 with that of the nip-roller support plate 52. Alternatively, such interlocking may not be performed and the nip-roller support plate 52 may be swung by another independent driving source such as a solenoid.

In the above-described first aspect, the nip-roller interlocking mechanism 53 has the nip-roller urging springs 57 for urging the nip roller 4 against the outer peripheral face 8*a* of the transport belt 8. In place of the nip-roller urging springs 57, other elastic members such as rubber members may be used, or members other than elastic members may be used.

In the above-described first aspect, the blade interlocking mechanism 55 interlocks the operation of the head unit moving mechanism 51 with that of the blade support plate 54. Alternatively, such interlocking may not be performed, and the blade support plate 54 may be swung by another independent driving source such as a solenoid.

In the above-described first aspect, the blade interlocking mechanism 55 has the blade urging springs 59 for urging the blade 31 against the outer peripheral face 8*a* of the transport belt 8. In place of the blade urging springs 59, other elastic members such as rubber members may be used, or members other than elastic members may be used.

In the above-described first aspect, in the printing process, the transport controlling portion 62 causes the transport belt 8 to travel after the blade 31 is contacted with the outer peripheral face 5*a* of the transport belt 8. Alternatively, in the printing process, the blade 31 may be contacted with the outer peripheral face 8*a* of the transport belt 8 after the transport belt 8 travels. According to the configuration, the frictional resistance at the start of traveling of the transport belt 8 is reduced.

In the above-described first and second aspects, the outer peripheral face 8*a* of the transport belt 8 is adhesive. Alternatively, the outer peripheral face 8*a* of the transport belt 8 may not be adhesive.

In the above-described first and second aspects, the inkjet printers 1, 101 have the line-type inkjet head 2. Alternatively, they may have a serial-type inkjet head.

What is claimed is:

1. An inkjet recording apparatus comprising:

a belt transporting apparatus including a plurality of rollers, an endless transport belt looped around the rollers and a transport belt driving unit which causes the transport belt to travel by rotating the rollers to move a recording medium placed on an outer peripheral face of the transport belt in a predetermined transportation direction;

a nip roller which is capable of nipping the recording medium in cooperation with the outer peripheral face at a predetermined position;

a nip-roller moving mechanism which moves the nip roller between a position where the nip roller is in contact with the outer peripheral face and a position where the nip roller is separate from the outer peripheral face;

an inkjet head including a plurality of nozzles for ejecting an ink to the recording medium on the transport belt;

an applying unit which applies cleaning fluid to the outer peripheral face;

a blade which is in contact with the outer peripheral face on a downstream side of a position where the cleaning fluid is applied to the outer peripheral face by the applying unit in a travel direction of the transport belt to scrape off the cleaning fluid and ink that adhere to the outer peripheral face;

a travel controlling unit which controls the transport belt driving unit to cause the transport belt to travel; and a nip-roller movement controlling unit which controls, when the transport belt starts to travel, the nip-roller moving mechanism to cause the nip roller to be contacted with the outer peripheral face after an initial contact place passes the predetermined position, the initial contact place being a place where the blade is initially contacted with the outer peripheral face.

2. The inkjet recording apparatus according to claim 1, wherein the applying unit applies the cleaning fluid to the outer peripheral face at a position, which is on a downstream side of a position where the transport belt opposes to the inkjet head and on an upstream side of the predetermined position in the travel direction of the transport belt, and the blade scrapes off the cleaning fluid and the ink at a position, which is on a downstream aide of the position where the applying unit applies the cleaning fluid and on the upstream side of the predetermined position.

3. The inkjet recording apparatus according to claim 1, further comprising a head moving mechanism which relatively moves the inkjet head with respect to the transport belt to allow the inkjet head to take either of a recording-enabled state where the inkjet head is close to the transport belt and a retracted state where the inkjet head is separate from the transport belt.

4. The inkjet recording apparatus according to claim 3, further comprising a first interlocking mechanism which interlockingly moves the head moving mechanism and the nip-roller moving mechanism to allow the nip roller to, when the recording-enabled state is taken, be in contact with the outer peripheral face, and, when the retracted state is taken, be separate from the outer peripheral face, and the nip-roller movement controlling unit controls the head moving mechanism to allow the inkjet head to take either of the recording-enabled state and the retracted state.

5. The inkjet recording apparatus according to claim 4, wherein the first interlocking mechanism includes a nip-roller urging unit which, when the recording-enabled state is taken, urges the nip roller toward the outer peripheral face, and, when the retracted state is taken, cancels the urging of the nip roller toward the outer peripheral face.

6. The inkjet recording apparatus according to claim 4, further comprising:

a blade moving mechanism which moves the blade between a contact position where the blade is in contact with the outer peripheral face and a separate position where the blade is separate from the outer peripheral face; and a second interlocking mechanism which interlockingly moves the head moving mechanism and the blade moving mechanism to allow the blade to, when the recording-enabled state is taken, be in contact with the outer peripheral face, and, when the retracted state is taken, be separate from the outer peripheral face, wherein, in a process of transferring from the retracted state to the recording-enabled state, the blade is contacted with the outer peripheral face, and then the nip roller is contacted with the outer peripheral face.

7. The inkjet recording apparatus according to claim 6, wherein the second interlocking mechanism includes blade urging unit which, when the recording-enabled state is taken, urges the blade toward the outer peripheral face, and, when the retracted state is taken, cancels the urging of the blade toward the outer peripheral face.

8. The inkjet recording apparatus according to claim 1, wherein the travel controlling unit causes the transport belt to travel after the blade is contacted with the outer peripheral face.

9. The inkjet recording apparatus according to claim 1, wherein the outer peripheral face of the transport belt is adhesive.

* * * * *